US005775545A

United States Patent [19]

Sullivan

[11] Patent Number: 5,775,545

[45] Date of Patent: Jul. 7, 1998

[54] METERING VALVE FOR AEROSOLS

[76] Inventor: Howard Michael Sullivan, "Fancote", 26 Honeypot Lane, Brentwood, Essex CM14 4QX, United Kingdom

[21] Appl. No.: 632,423

[22] PCT Filed: Oct. 26, 1993

[86] PCT No.: PCT/GB93/02206

§ 371 Date: Apr. 24, 1996

§ 102(e) Date: Apr. 24, 1996

[87] PCT Pub. No.: WO95/11841

PCT Pub. Date: May 4, 1995

[51] Int. Cl.[6] ..... B65D 83/14

[52] U.S. Cl. ..... 222/207; 222/402.2; 222/402.24

[58] Field of Search ..... 222/207, 9, 402.1, 222/402.2, 402.24, 321.8, 321.9, 321.2

[56] References Cited

U.S. PATENT DOCUMENTS 2,835,417 5/1958 Kiraly ..... 222/402.2

FOREIGN PATENT DOCUMENTS 222229 11/1957 Australia ..... 222/402.24

*Primary Examiner*—Philippe Derakshani

*Attorney, Agent, or Firm*—Beveridge, DeGrandi, Weilacher & Young, LLP

[57] ABSTRACT

A metering valve to be fitted to an aerosol container comprises a dispensing member (6) in the form of a tube and a metering member (2) in the form of a cylindrical cup which receives the inner end of the tube (6). The dispensing tube (6) is slidable in an opening in a valve housing (11). A bellows (1) extends between the inner end of the dispensing tube (6) and the housing (7) to seal against escape between the dispensing tube (6) and the opening in the valve housing (7). The inner end of the dispensing tube (6) bellows (1) seals against a seat (9) in the floor of the metering cup (2). The upper end of the metering cup (2) seals against a seat (3) which lies against the upper end of the bellows (1).

16 Claims, 4 Drawing Sheets

METERING VALVE FOR AEROSOLS

BACKGROUND AND SUMMARY OF THE INVENTION

This invention relates to a metering valve for aerosols.

Valves are known which are affixed to aerosol cans and are designed to release one measured dose of product/propellant mixture per actuation. These valves are typically used with medicinal aerosols, such as Metered Dose Inhalers for treating asthma and other conditions, where the product is a powdered drug suspended in a liquid propellant. There is a present need for a design of metering valve which does not employ any sliding sealing faces because some products or powders can migrate past this type of seal and cause leakage or incorrect dosage. Examples of aerosols utilising sliding seal type metering valves are shown in U.S. Pat. No. 3,301,444.

U.S. Pat. No. 2,835,417 describes a metered dosage valve for a container of fluid under pressure. The valve has a tubular measuring chamber having a resilient sealing gasket at one end with a central opening through which a hollow valve stem extends into the measuring chamber. The stem is depressable to close a normally open discharge passage from the measuring chamber and then supply fluid to the measuring chamber. When the valve stem is moved downwardly from its normal position, the centre portion of the gasket is bent downwardly so that when the downward force on the stem is released, the resilient gasket acts to urge the valve stem upwardly to its initial position.

Although this seal does not involve a sliding action, after repeated deformation resulting from operation of the stem the gasket is likely to deteriorate and become less resilient which would lead to less efficiency in the sealing of the valve and allow migration of products or powders past it. Furthermore, it could lead to less effective sealing against the valve stem which would lead to the same problems mentioned above in that some products or powders could migrate past the seal and cause leakage or incorrect dosage.

Therefore according to the invention, there is provided a metering valve to be fitted to an aerosol container for dispensing a product, said valve comprising a housing, a metering chamber located within said housing and a hollow actuator stem extending into the chamber and axially slidable relative thereto, the metering chamber and actuator stem being moveable into and out of positive sealing contact with oppositely facing valve seats provided on the valve housing and the metering chamber respectively, and sealing means being provided between the actuator stem and the housing and fixed to the housing such that relative movement between the stem and housing is permitted, characterised in that the sealing means consist of a flexible web or membrane fixed to the actuator stem.

The provision of oppositely facing valve seats with a fixed flexible membrane or web averts the use of sliding or deforming seals resulting in a considerably improved metering valve.

In each of the metering valves described in U.S. Pat. No. 3,301,444, a further problem arises in that the metering chamber which receives aerosol prior to dispensing is refilled with a fresh dose of aerosol immediately after the previous dose of aerosol has been dispensed therefrom. The fresh dose then remains in the metering chamber until the valve is subsequently operated to dispense the next dose. Such an arrangement is disadvantageous in that the fresh does of aerosol can tend to drain from the metering chamber at least to some extent over a period of time. When that happens, the next dispensed dose will be incomplete and can have undesirable consequences for a person suffering, for example, from asthma where the correctness of the initial dose is important. Moreover, where a fresh charge of aerosol remains in the metering chamber for a long period of time, the suspended drug can settle in the chamber and will not be properly discharged from the dispensing chamber when the next dose is dispensed.

The invention further provides that the metering chamber receives aerosol for dispensing by the actuator stem and the sealing contact of the metering chamber against its associated valve seat prevents a fresh charge of aerosol entering the metering chamber after a previous charge has been dispensed therefrom, until the metering chamber and associated seal are subsequently separated by operating the valve to dispense a further dose.

With such a valve, the metering chamber is not refilled with a fresh dose of aerosol until the user of the aerosol next operates the valve to dispense the aerosol. Therefore, fresh doses will not be left in the metering chamber for periods of time between dispensings.

BRIEF DESCRIPTION OF THE DRAWINGS

A preferred form of the invention will be described, by way of example, with reference to the accompanying drawings, in which.

DETAILED DESCRIPTION OF THE DRAWINGS

Figure 1:
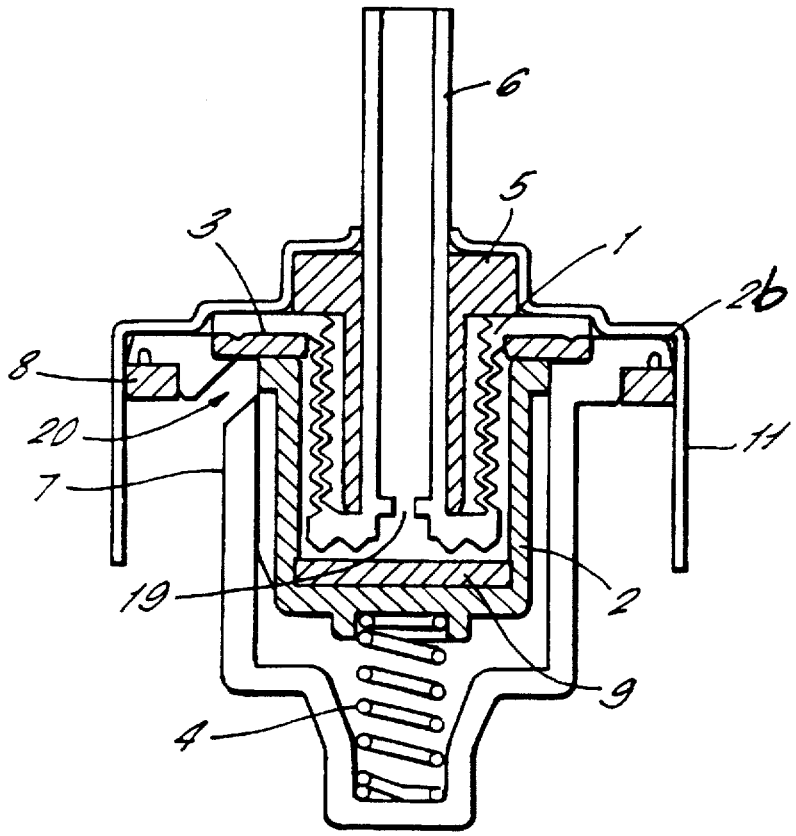
FIG. 1 is a cross section through a valve in accordance with the invention before being fitted to an aerosol container.
Figure 2:
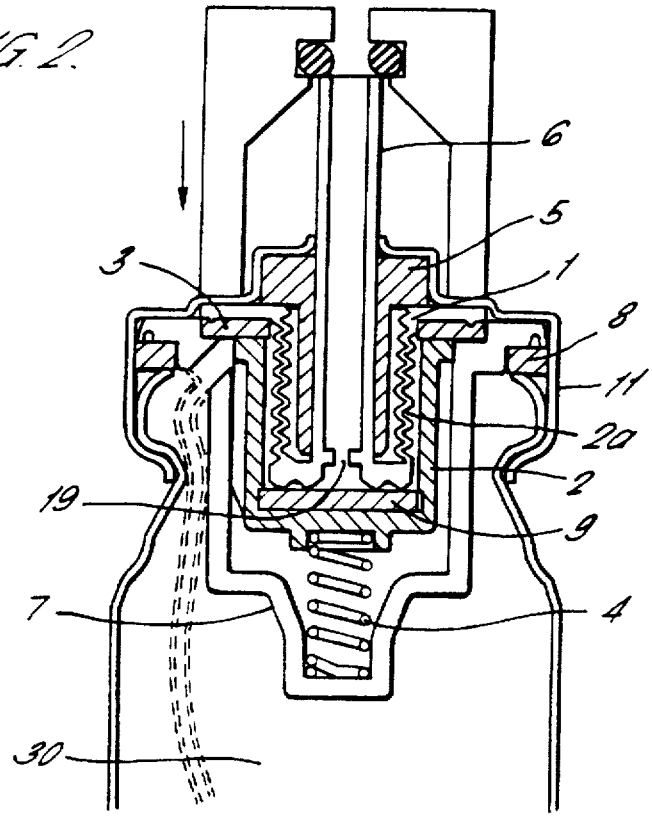
FIG. 2 is a cross-sectional view of the valve of FIG. 1 fitted to an aerosol container and showing a filling nozzle applied to the outer end of the dispensing stem.

Referring to FIG. 1, a valve housing 7 provided with at least one port 20 in the upper part of its wall, contains a metering member 2 defining a metering chamber 2*a* of a size dependent upon the dose to be dispensed. The member 2 is normally urged by a spring 4 into a closed position in which its upper end, provided with one or more sealing rings 2*b*, makes sealing contact with the lower face of a valve seat 3 in the form of a gasket to form inlet valve means to isolate the chamber 2*a*; from the interior of the housing 7. The chamber 2*a* contains a further valve seat 9, which may be made of a compatible elastic material such as synthetic rubber, for sealing contact with the lower end of a dispensing member stem 6 when the latter is moved into its closed position to form outlet valve means to isolate from the chamber 2*a* the interior of the stem, which defines an outlet. The stem 6, which may contain a constriction 19 to assist atomization of the aerosol mixture, is centralised and supported for linear movement relative to the member 2 by a guide 5 which may be extended, as shown, to limit return travel of the stem. The inner end of the stem 6 is secured to or formed integrally with one end of a membrane or web in the form of a resilient bellows 1. The bellows may have a helical, thread-like form to facilitate moulding from plastics. The other end of the bellows 1 bears against a shoulder formed on the guide 5 and is provided with an external flange which is clamped between the top of the housing 7 and the valve seat 3 by a ferrule 11 which may be made of an aluminium alloy and also serves to secure the guide 5 and a sealing ring 8 for engagement with the mouth of an aerosol container when the ferrule is secured to the container by crimping, as shown in FIG. 2. The bellows 1 prevents leakage of aerosol between the stem 6 and the open end of the housing 7 and in particular between the external surface of the stem 6 and the The resilient membrane or web normally biases the actuator stem away from valve seat 9.

Figure 3:
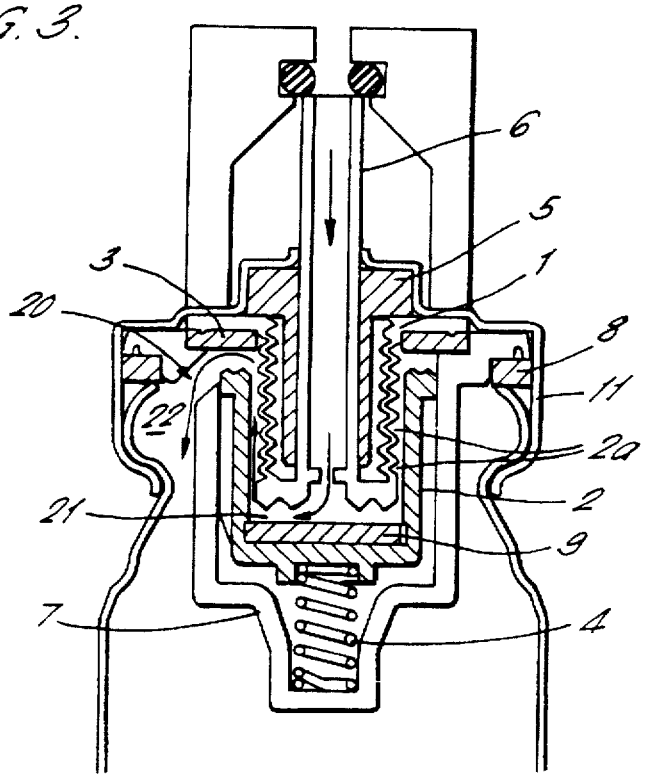
FIG. 3 is a view similar to FIG. 2, showing the positions of the valve members during filling.

The container may be pre-filled before fitting the valve or filled with the valve in position using a pressure filling machine in the manner illustrated in FIGS. 2 and 3.

Referring to FIG. 2, the nozzle of the filling machine is applied to the outer end of the stem 6 which moves downward into sealing engagement with the valve seat 9. The supply of mixture under pressure through the stem 6 acts on the lower end of the chamber 2 which moves downward into its open position to permit the mixture to pass from the stem 6 through the chamber 2 and into the container through the port 20, as illustrated by the arrows 21 and 22 in FIG. 3.

Figure 4:
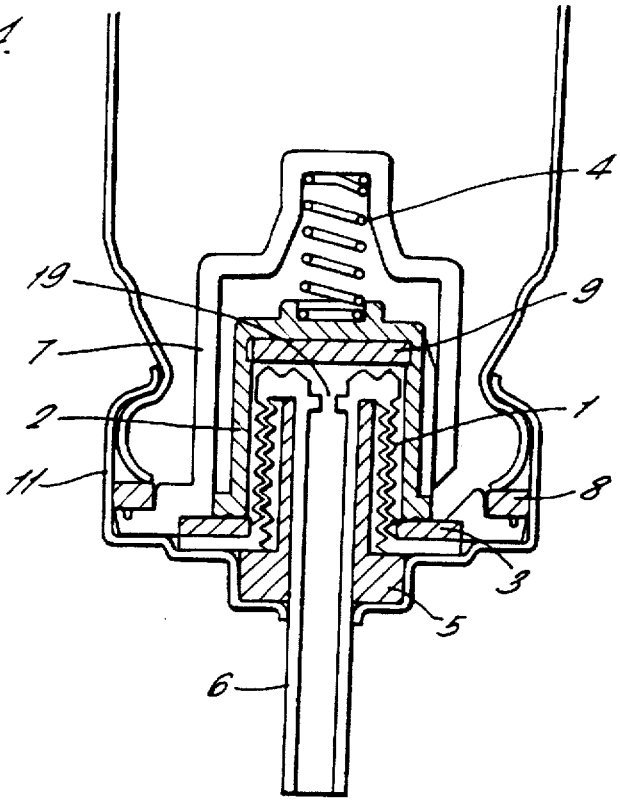
FIG. 4 is a cross-sectional view of the top of the filled container in inverted position prior to dispensing.

When the container has been filled the valve members return to the positions shown in FIG. 1 and FIG. 4, the latter showing the container inverted prior to dispensing a metered dose of its contents.

Figure 5:
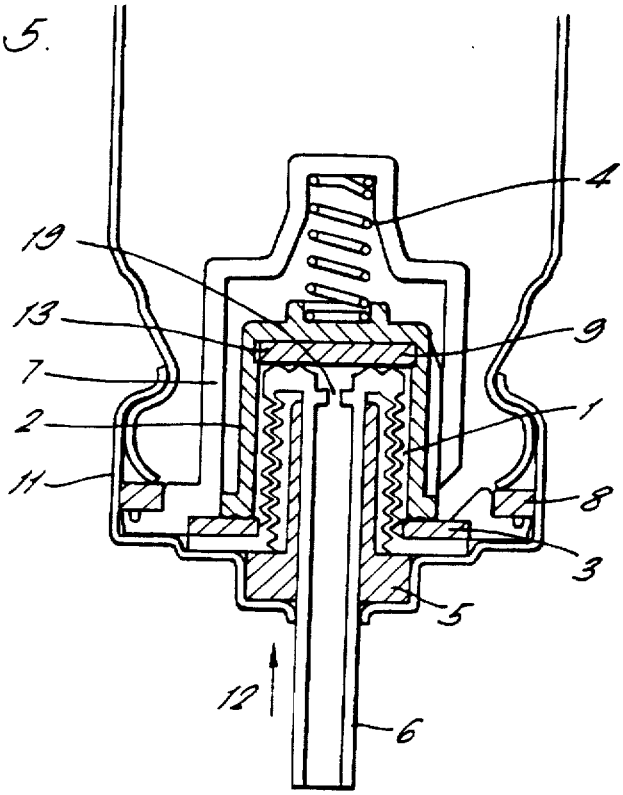
FIGS. 5 to 7 are views similar to FIG. 4, illustrating successive stages of the dispensing process.
Figure 6:
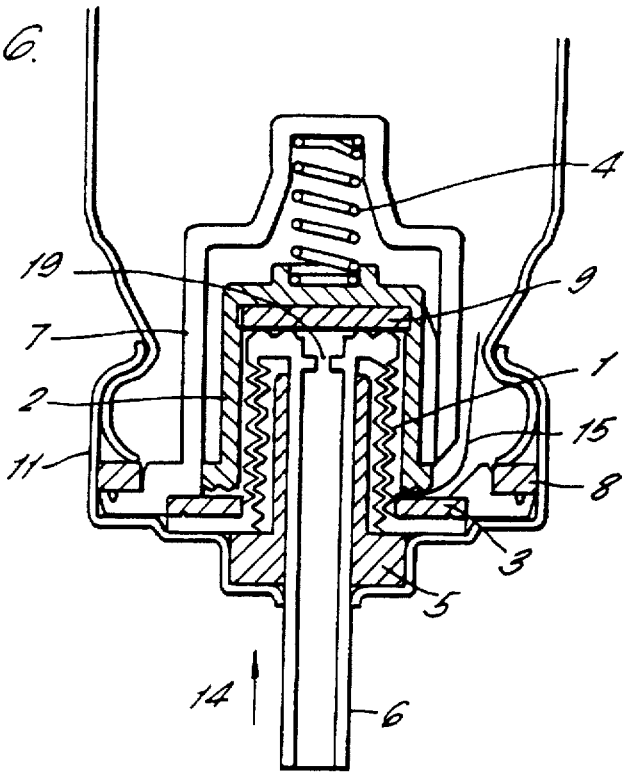
Figure 7:
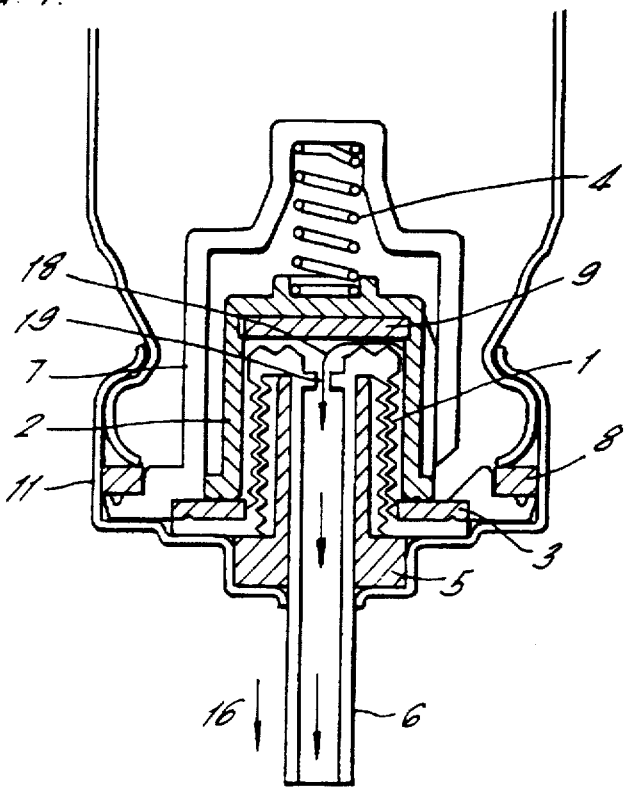

For dispensing, an actuator (not shown) is affixed to the outer portion of the stem 6 and the latter is moved upward in the direction of the arrow 12 in FIG. 5 to bring the base of the stem into sealing engagement with the valve seat 9 to isolate the metering chamber from atmosphere as indicated at 13 in FIG. 5. Further movement of the stem 6 in the direction of the arrow 14 in FIG. 6, moves the open end of the chamber 2 away from the valve seat 3 (which is oppositely facing with respect to the valve seat 9) to allow the aerosol mixture from the container to fill the chamber **2*a* as indicated at 15 in FIG. 6 and provide the metered dose therein. The valve is then primed ready for dispensing, and by moving the stem 6 in the opposite direction, as indicated by the arrow 16 in FIG. 7, the contents of the chamber 2 are expelled through the stem, as indicated by the arrows 18 in FIG. 7, and when the actuator is released the stem is returned to its original position by the bellows 1 and the spring 4. Instead of the stem 6 passing through the centre of the bellows 1**, the latter may be inverted and the stem affixed to its upper end.

It will be appreciated that the metering chamber **2*a* remains empty after the metered dose therein has been dispensed by operation of the stem 6. Only upon subsequently operating the stem 6 to dispense a further dose of aerosol will the metering chamber 2*a*** refill to provide another metered dose.

The valve housing 7 is also capable of acting as a dip cup when the aerosol container is required to be emptied in an inverted position. For that end the port 20 in the wall of the valve housing 7 is provided at the highest point of the main container cavity. The port 20 is thus at the lowest point of the cavity when the container is upside-down for use and so the entire content of the container can drain through the port 20 for dispensing.

Also a small tube 30 indicated in broken lines in FIG. 2, may be positioned with one end sealingly located in the port 20 and its opposite end positioned near the closed lower end of the container. When the user operates the valve with the container in the FIG. 2 position, aerosol will travel up the tube 30 and into the chamber **2*a***.

Instead of providing a resilient bellows 1, a non-resilient flexible membrane or web may be provided to prevent leakage of aerosol between the stem 6 and the open end of the housing 7. Pressure of the aerosol in the metering chamber **2*a* will be sufficient to move the stem 6 away from the valve seat 9 to dispense the aerosol but, if necessary, the stem could be biased normally away from the valve seat 9 by means of a spring, eg, as indicated at 32 in broken lines in FIG. 1**.

The term "aerosol" as used herein includes a pressurised dispensing container charged with a liquid product and pressurised by a liquid propellent which is volatile at room temperature. The term "aerosol" as a term of art also refers to the liquid in the container as required by context.

I claim:

1. A metering valve to be fitted to an aerosol container for dispensing a product, said valve comprising:

a housing;

a metering chamber located within said housing;

a hollow actuator stem extending into the chamber and axially slidable relative thereto, the metering chamber and actuator stem being moveable into and out of positive sealing contact with oppositely facing valve seats provided on the valve housing and the metering chamber respectively; and sealing means being provided between the actuator stem and the housing and fixed to the housing such that relative movement between the stem and housing is permitted, wherein the sealing means consist of a flexible web or membrane fixed to the actuator stem; and the resilient membrane or web is a bellows assembly.

2. A metering valve according to claim 1, wherein bias means is provided for normally biasing the actuator stem away from the valve seat on the metering chamber.

3. A metering valve according to claim 1, wherein the membrane or web normally biases the actuator stem away from the valve seat on the metering chamber.

4. A metering valve according to claim 1, wherein the membrane or web partly defines said metering chamber.

5. A metering valve according to claim 1, wherein the positive sealing contact with the valve seats provides an outlet valve means for sealing an outlet in the actuator stem from the metering chamber and inlet valve means for sealing the metering chamber from a main reservoir.

6. A metering valve according to claim 5, wherein the inlet valve means can only be opened when the outlet valve means is closed.

7. A metering valve according to claim 5, wherein the inlet valve means is opened by movement of the actuator stem.

8. A metering valve according to claim 7, wherein linear movement of the actuator stem over a first distance closes the outlet valve means and further movement in the same direction over a second distance opens the inlet valve means linear movement in the reverse direction operating the valve means in reverse.

9. A metering valve according to claim 5, wherein the outlet valve means comprises the valve seat mounted on the metering chamber.

10. A metering valve according to claim 9, wherein said metering chamber defines an open end for sealing engagement with the valve seat on said housing and is provided at its closed end with the valve seat of the outlet valve means.

11. A metering valve according to claim 1, wherein the metering chamber defines a cylindrical cup which receives the inner end of the actuator stem.

12. A metering valve according to claim 5, wherein the seat of the inlet valve means is mounted on the housing.

13. A metering valve according to claim 12, wherein bias means is provided characterized in that the cylindrical cup also receives at least part of the bias means.

14. A metering valve according to claim 8, wherein the actuator stem is returned over the second distance by a second spring means.

15. A metering valve according to claim 1, wherein a housing is provided for the valve which also acts as a dip cup when an aerosol is required to be emptied in an inverted position.

16. A metering valve according to claim 1, in which the metering chamber receives aerosol for dispensing by the actuator stem and the sealing contact of the metering chamber against its associated valve seat prevents a fresh charge of aerosol entering the metering chamber after a previous charge has been dispensed therefrom, until the metering chamber and associated seal are subsequently separated by operating the valve to dispense a further dose.

* * * * *